US007057126B1

(12) United States Patent
Lin

(10) Patent No.: US 7,057,126 B1
(45) Date of Patent: Jun. 6, 2006

(54) PRESS BUTTON LIGHT EMITTING STRUCTURE

(75) Inventor: Chih-Shu Lin, Taipei (TW)

(73) Assignee: Sunwave Technology Corp., Taipei (TW)

( * ) Notice: Subject to any disclaimer, the term of this patent is extended or adjusted under 35 U.S.C. 154(b) by 0 days.

(21) Appl. No.: 11/139,579

(22) Filed: May 31, 2005

(51) Int. Cl.
*H01H 9/00* (2006.01)

(52) U.S. Cl. ..... 200/314; 200/317

(58) Field of Classification Search ..... 200/310–314, 200/317
See application file for complete search history.

(56) References Cited

U.S. PATENT DOCUMENTS 4,471,189 A * 9/1984 Bacon et al. ..... 200/516
5,408,060 A * 4/1995 Muurinen ..... 200/314
5,847,336 A * 12/1998 Thornton ..... 200/5 A
6,104,319 A * 8/2000 Shpater ..... 341/23
6,255,610 B1 * 7/2001 Botz et al. ..... 200/315
6,590,174 B1 * 7/2003 Zysnarski et al. ..... 200/310

* cited by examiner

*Primary Examiner*—Richard K. Lee

(57) ABSTRACT

A press button light emitting structure consists of a light-pervious press button circuit board and a light guiding board installed underneath light-pervious press buttons, wherein peripheries of the light guiding board are pasted with light emitters. Light can be uniformly distributed and transmitted in an interior of the light guiding board, and penetrate out from the light-pervious press button circuit board and press buttons, when the light emitters emit light. The light penetrated out has a good brightness and uniformity. In addition, a control circuit is used to dynamically control lighting display, such as an on/off, brightness, and color, to the light emitters.

4 Claims, 10 Drawing Sheets

PRESS BUTTON LIGHT EMITTING STRUCTURE

BACKGROUND OF THE INVENTION (a) Field of the Invention

The present invention relates to a press button light emitting structure, and more particularly to a light emitting structure wherein a press button circuit board which is pervious to light and a light guiding board are installed underneath the press buttons respectively, and the peripheries of light guiding board are pasted with light emitters, such that light can be uniformly distributed and transmitted in an interior of the light guiding board and penetrate out from the press button circuit board which is pervious to light and the press buttons when the light emitters emit light. The light penetrated out has a good brightness and uniformity.

When the light enters the light guiding board from the light emitters, is uniformly distributed in the interior of the light guiding board, and penetrates out from the press button circuit board which is pervious to light and the press buttons, a control circuit is controlling an on/off, brightness, and color to the light emitters.

(b) Description of the Prior Art

Most of the existing electronic products employ press buttons as their operating interfaces, such as a mobile phone, a computer keyboard, and a remote controller. However, in order to improve a convenience in usage in a condition without a good lighting, a function of lighting will be added to most of the press button circuits.

As shown in FIG. 1, a plurality of light emitting diodes C (with characteristics of long lifetime and ease of driving) are installed on a control circuit board B. Light will directly penetrate out after pasting press buttons A with the control circuit board B. However, a plurality of point light sources are constructed when the plurality of light emitting diodes emit light simultaneously, which will not be able to easily cause a uniform brightness. If more light emitting diodes C are added to increase the brightness, power consumption will also be increased.

Referring to FIG. 2, a luminescence board D (with characteristics of short lifetime, light in weight and thin, and hard to drive) is installed between press buttons A and a control circuit board B. Light will penetrate out after pasting the press buttons A with the luminescence board D. However, for the existing luminescence board D, its brightness is low and power consumption is high, and an extra driving circuit D1 should be installed for using the luminescence board D. Furthermore, a noise will be generated when the luminescence board D is emitting light.

Accordingly, how to provide a press button light emitting structure which has a low cost, is light in weight and thin, has a long lifetime, is easy to drive, consumes less power, has a high brightness, can change colors, and has a uniform light is a technical issue to be solved by the present inventor.

SUMMARY OF THE INVENTION

As shown in FIG. 3 and FIG. 4, the present invention is composed of press buttons which are pervious to light, a press button circuit board which is pervious to light, a control circuit board, and a light guiding board, wherein the control circuit board is provided with a control circuit for dynamically controlling characteristics related to light display of light emitters, such as colors of light, brightness of light, and time of lighting (period, frequency), and the press button circuit board which is pervious to light is provided with a connection cable for connecting with the aforementioned control circuit board.

The press buttons are pasted on the press button circuit board which is pervious to light, and then are overlapped on the light guiding board, whereas the light emitters are pasted on peripheries of the light guiding board.

When light enters the light guiding board from the light emitters, is uniformly distributed in an interior of the light guiding board, and penetrates out from the press button circuit board which is pervious to light and the press buttons, the control circuit is controlling an on/off, brightness, and color to the light emitters. Furthermore, the light penetrated out has a high and uniform brightness.

The light emitters can be a single-color light emitter, a multi-color light emitter, and further an SMD-LED (Surface-Mount Device Light Emitting Diode), an LED (Light Emitting Diode), a luminescence board, a luminescent cathode ray tube, and a related electronic light emitting device.

The press buttons and the press button circuit board can be further installed as press buttons for a personal computer keyboard, a notebook computer keyboard, a calculator, a palm electronic device, a telephone set, a mobile phone, a remote controller of house appliances, and a related structure with press buttons pasted on a press button circuit board. In addition, the aforementioned press buttons and press button circuit board are pervious to light.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 5:
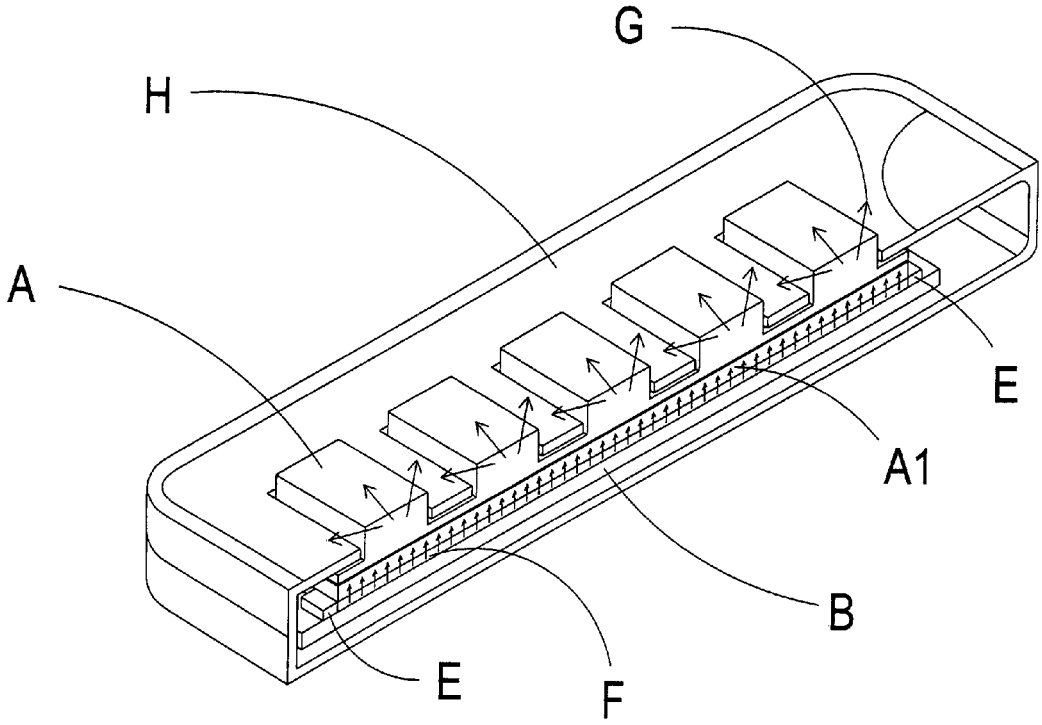
FIG. 5 shows a cross sectional view of an implementation of the present invention.
Figure 6:
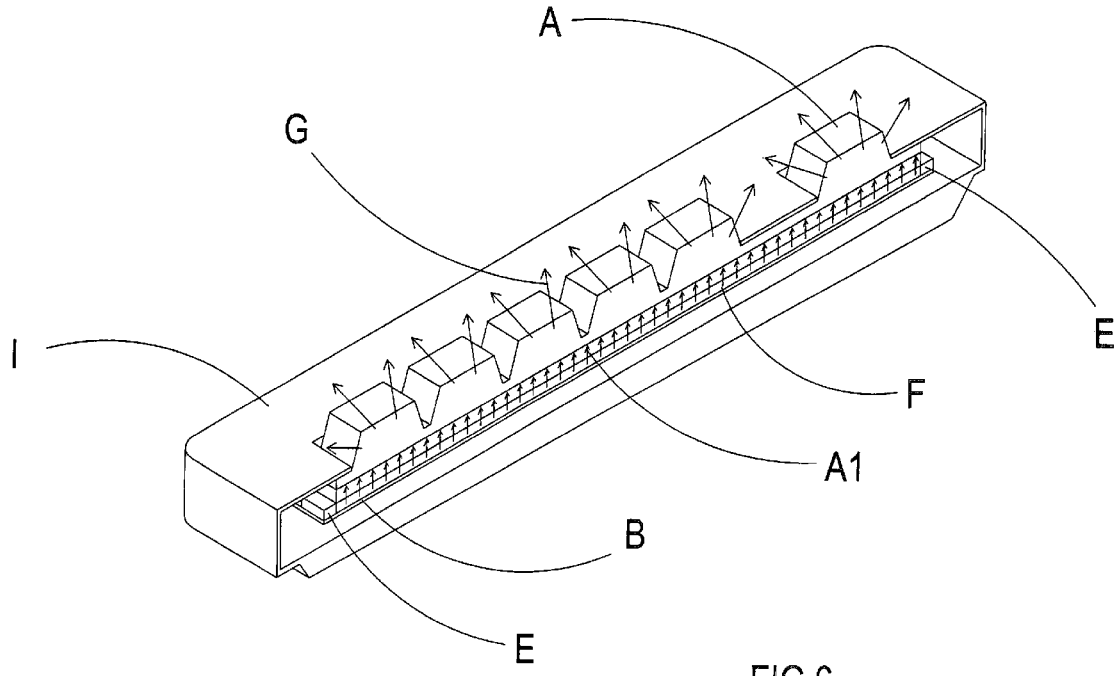
FIG. 6 shows a second cross sectional view of an implementation of the present invention.
Figure 7:
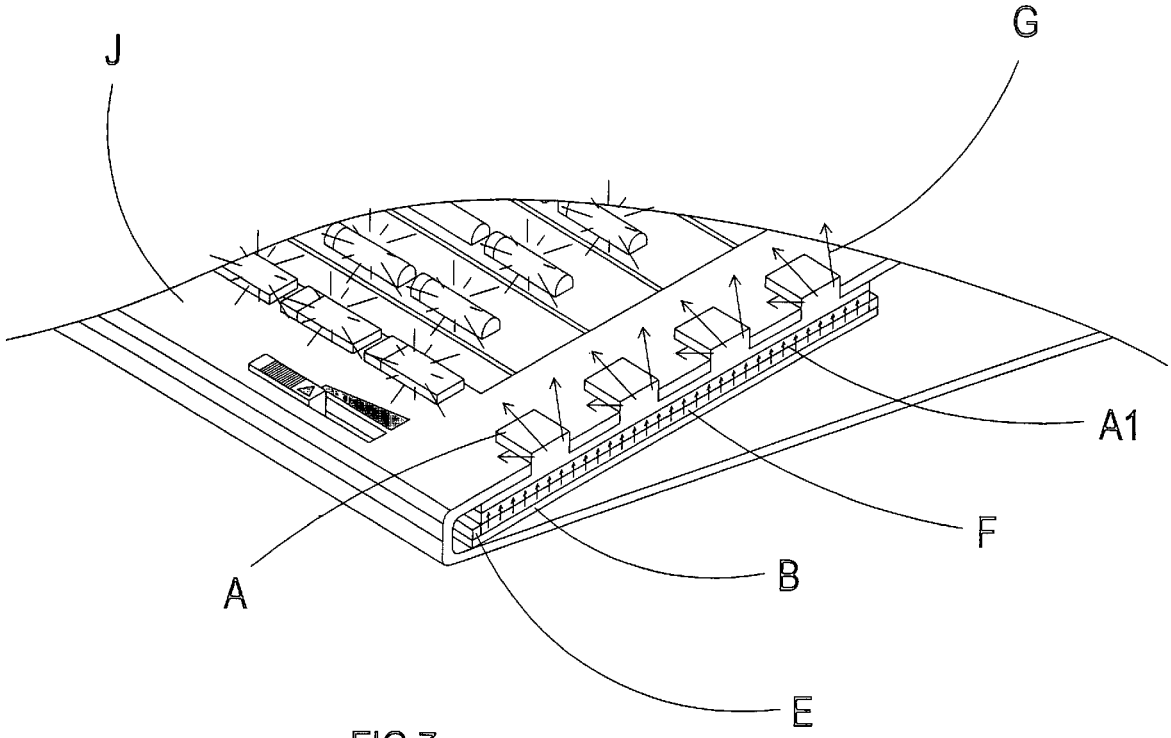
FIG. 7 shows a third cross sectional view of an implementation of the present invention.

Referring to FIG. 5, FIG. 6, and FIG. 7, a light guiding board F, a press button circuit board A1 which is pervious to light, and press buttons A which are pervious to light, are installed and overlaid in sequence on a control circuit board B inside a remote controller H, a keyboard I, and a telephone set J. When light G enters the light guiding board F from light emitters E, is uniformly distributed in an interior of the light guiding board F, and penetrates out from the light-pervious press button circuit board A1 and press buttons A, a control circuit B1 is controlling the light emitters E to emit light.

The light-pervious press buttons A and press button circuit board A1 are made of light-pervious material, and the light G emitted from the press buttons A has a high and uniform brightness.

Figure 1:
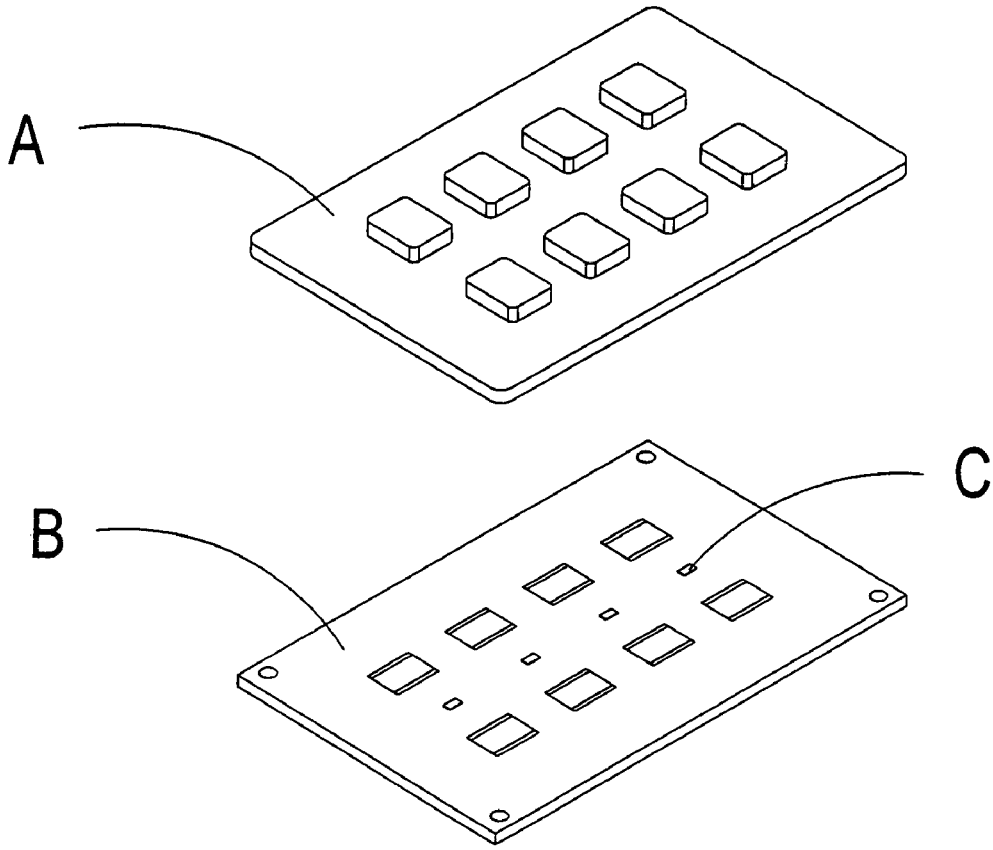
FIG.1 Prior Art
FIG. 1 shows a perspective view of compartments of a conventional light emitting press button structure of a light emitting diode.
Figure 2:
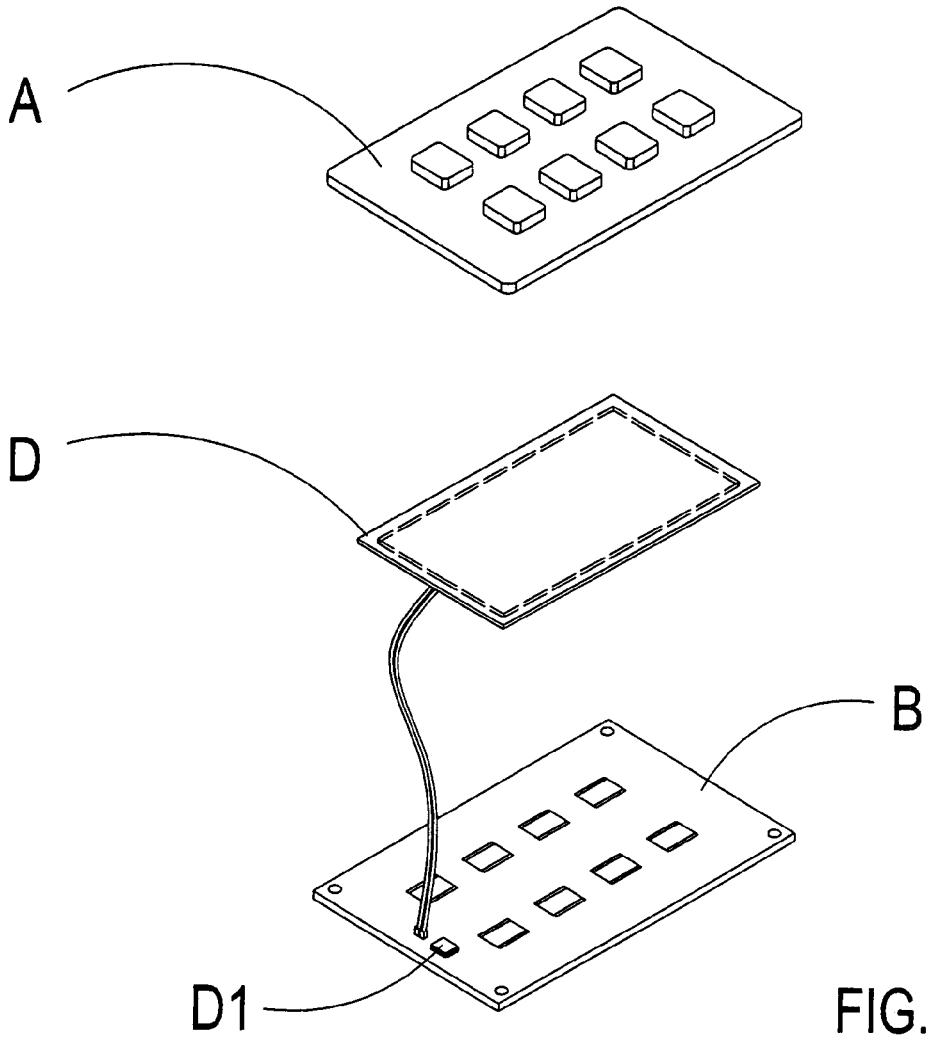
FIG.2 Prior Art
FIG. 2 shows a perspective view of compartments of a conventional light emitting press button structure of a luminescence board.
Figure 3:
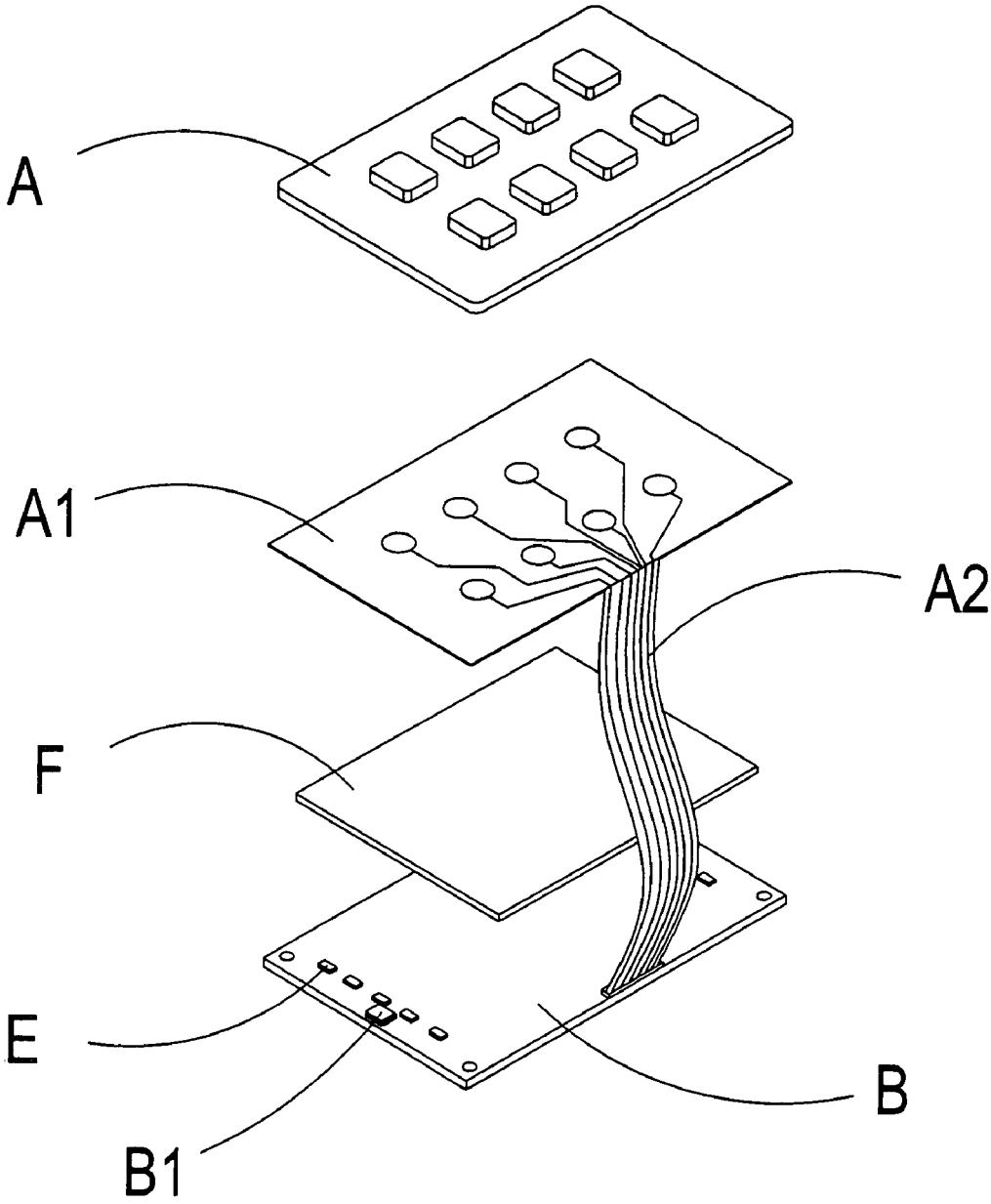
FIG. 3 shows a perspective view of compartments of the present invention.
Figure 4:
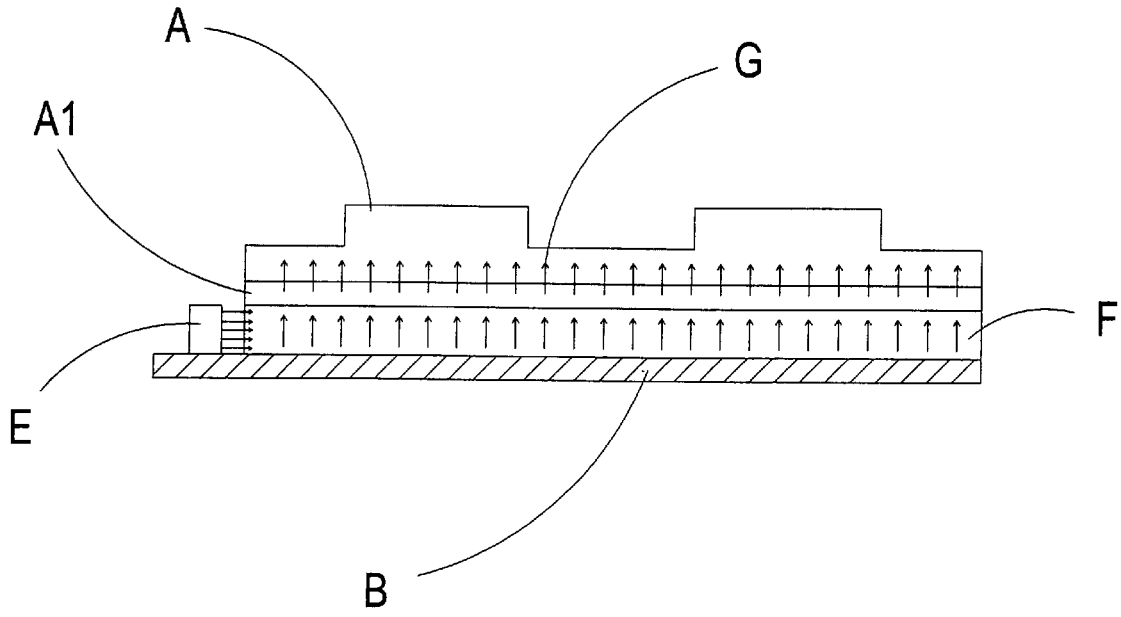
FIG. 4 shows a cross sectional view of the present invention.
Figure 8:
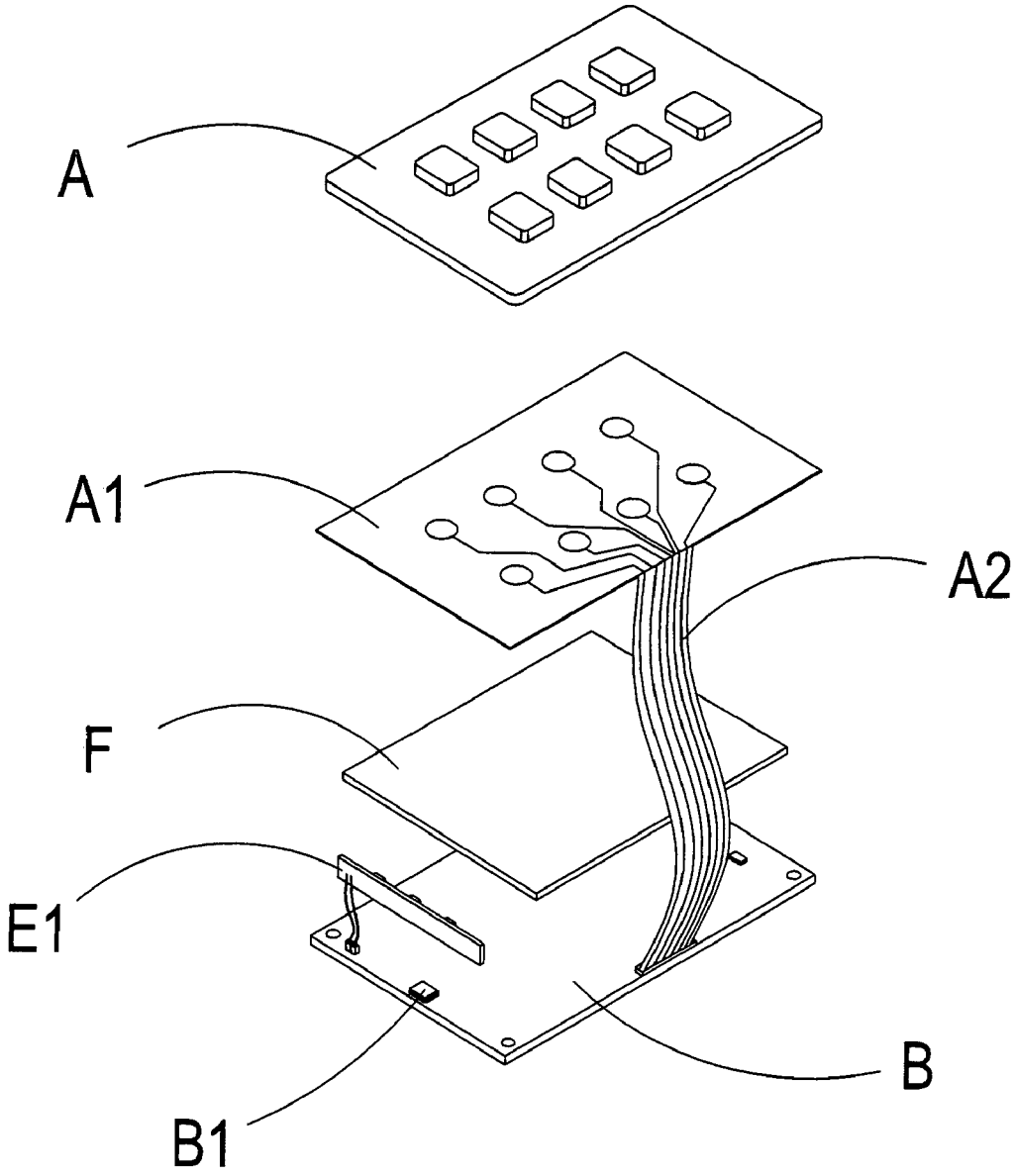
FIG. 8 shows a perspective view of compartments of another implementation of the present invention.

Referring to FIG. 3 and FIG. 8, the light emitters E can be installed on the control circuit board B, or an independent light emitter E1 can be used. The light emitters E, E1 are pasted at a location of incoming light at a side of the light guiding board F, and the light-pervious press button circuit board A1 and press buttons A are installed in sequence, whereas the light-pervious press button circuit board A1 is provided with a connection cable A2 for connecting with the control circuit board B.

When light enters the light guiding board F from the light emitters E, E1, is uniformly distributed in an interior of the light guiding board F, and penetrates out from the light-pervious press button circuit board A1 and press buttons A, the control circuit B1 is controlling an on/off, brightness, and color to the light emitters E, E1.

The light-pervious press buttons A and press button circuit board A1 are made of light-pervious material, and the light emitted from the press buttons A has a high and uniform brightness.

Figure 9:
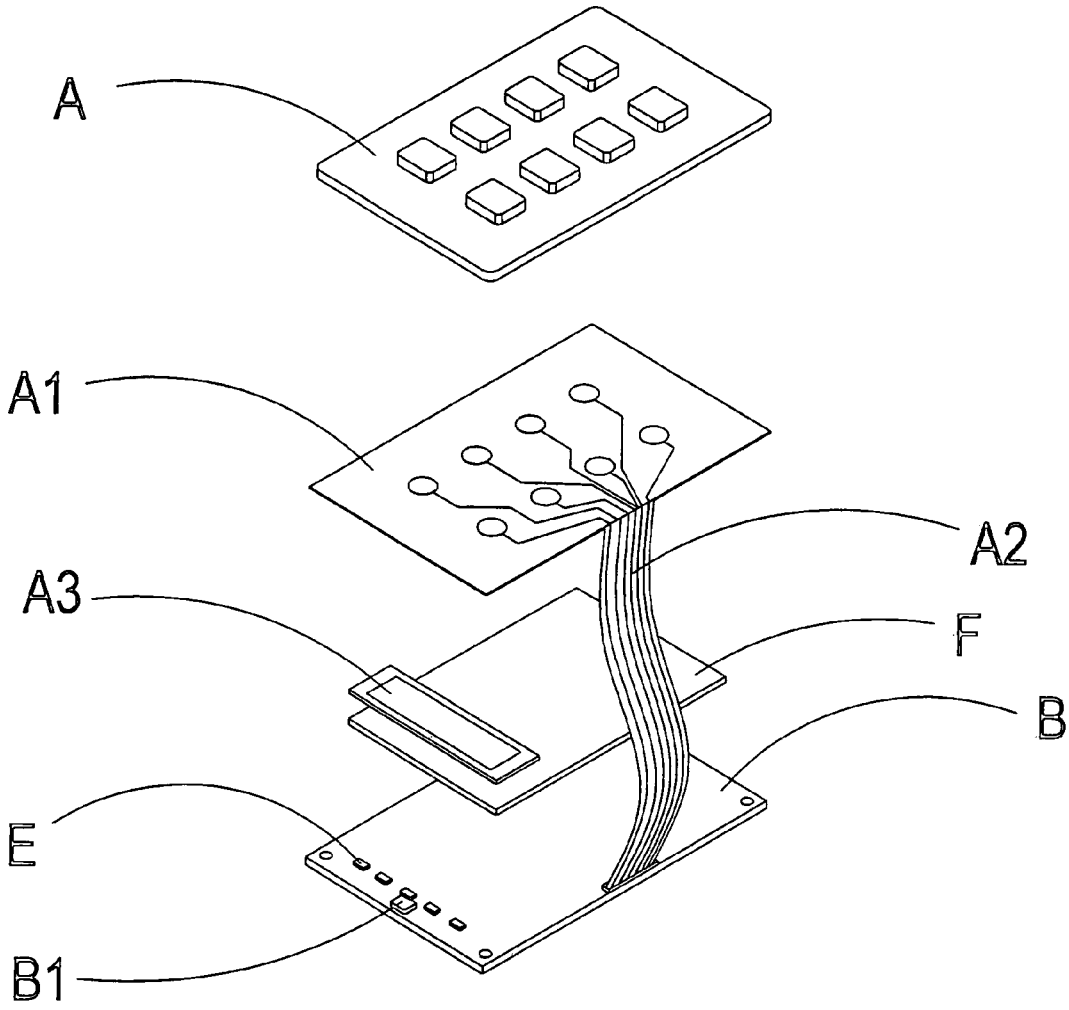
FIG. 9 shows a schematic view of a second implementation of lighting of the present invention.
Figure 10:
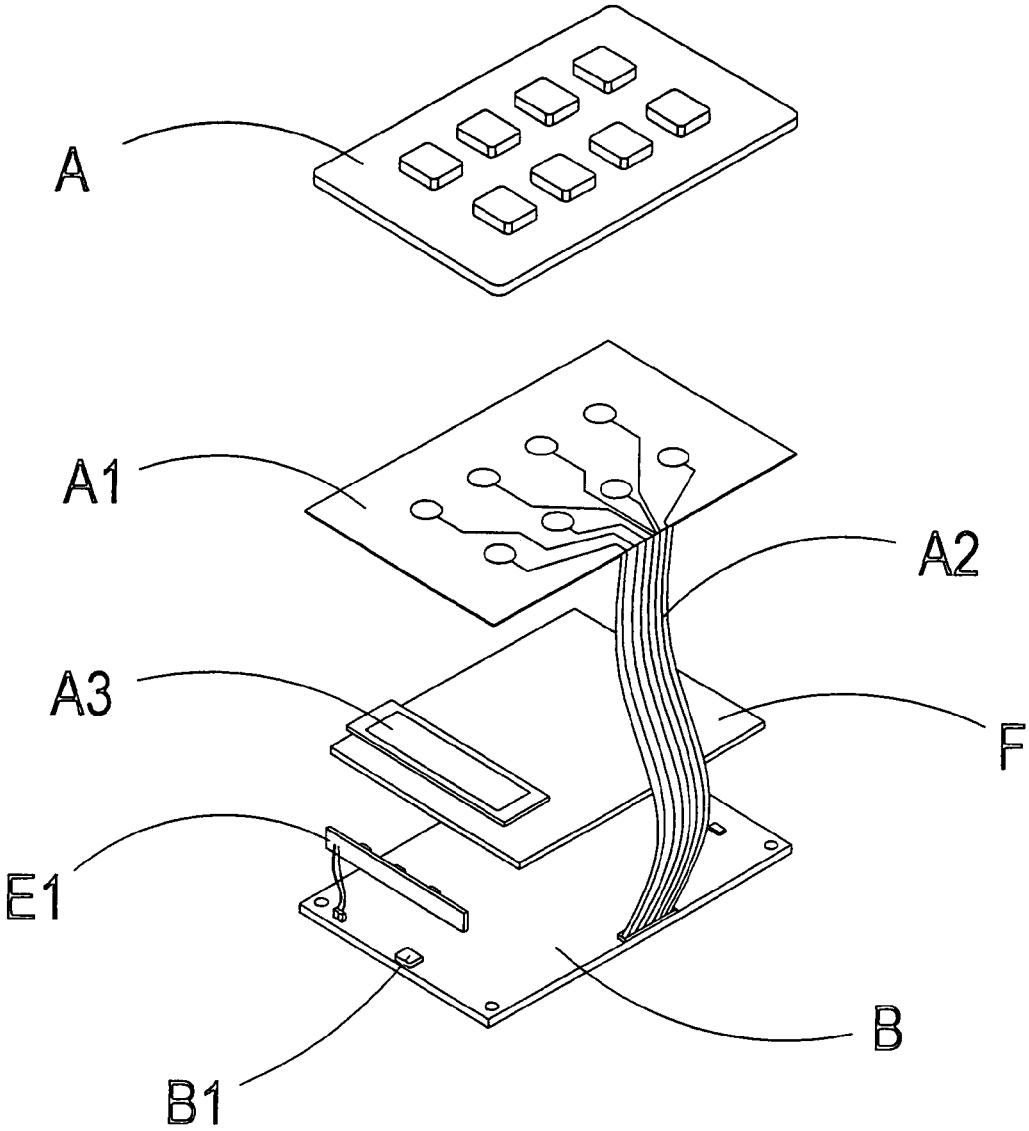
FIG. 10 shows a schematic view of a third implementation of lighting of the present invention.

Furthermore, if a liquid crystal display panel A3 (as shown in FIG. 9 and FIG. 10) is installed, the aforementioned light G can further provide a high and uniform brightness to the liquid crystal display panel A3.

To further manifest the advancement and practicability of the present invention, the present invention is compared with a conventional application as follow:

Shortcomings of a conventional application (1) For a light emitting diode

The brightness is not uniform.

More quantity should be used to achieve a better uniformity of brightness.

It consumes more power as a large quantity of light emitting diodes is used.

(2) For a luminescence board

The brightness is low; therefore the effect of lighting is not significant.

An extra driving circuit should be installed; therefore cost will be increased.

It consumes large power, which induces a short lifetime of continuous usage.

A noise will be generated upon lighting.

(3) It cannot be used for a long time.

(4) It consumes higher power, which induces a short lifetime of continuous usage.

(5) The changeability of light is low.

Advantages of the present invention (1) It is easy to assemble, and its cost is low.

(2) It consumes lower power, which can increase a lifetime of continuous usage.

(3) The brightness is high and uniform.

(4) It can emit light without an extra driving circuit.

(5) It is provided with a dynamic effect of lighting.

(6) The lighting structure has a high compatibility, which is suitable for the existing press button structures.

(7) It has the advancement, practicability and convenience.

(8) It can improve an industrial competitiveness.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A press button light emitting structure comprising at least one set of light-pervious press buttons whose bottom is provided with a light-pervious press button circuit board which is installed with at least one set of connection cable for connecting with a circuit board; the circuit board provided with at least one set of light emitters and said connection cable for connecting with said light-pervious press button circuit board, and a control circuit for dynamically controlling lighting display of said light emitters; a light guiding board installed between said circuit board and the light-pervious press button circuit board, and with peripheries of the light guiding board pasted with said emitters; light emitted uniformly distributed inside the light guiding board and penetrating to the light-pervious press button circuit board and press buttons upon lighting by the light emitters, so as to emit the light of a uniform brightness and a stable lumen from the press buttons.

2. The press button light emitting structure according to claim 1, wherein the light guiding board can further provide a light source of uniform brightness and stable lumen to a liquid crystal display panel.

3. The press button light emitting structure according to claim 1, wherein the light emitters can be a single-color light emitter, a multi-color light emitter, and can be further an SMD-LED, an LED, a luminescence board, a luminescent cathode ray tube, an a related electronic light emitting device.

4. The press button light emitting structure according to claim 1, wherein the press buttons and light-pervious press button circuit board can be further installed as press buttons for a remote controller, a computer keyboard, a calculator, a palm electronic device, a telephone set, and a related press button structure provided with press buttons pasted on a light-pervious press button circuit board.

* * * * *